US007085353B2

(12) United States Patent
Yoshiyama et al.

(10) Patent No.: US 7,085,353 B2
(45) Date of Patent: Aug. 1, 2006

(54) X-RAY TUBE

(75) Inventors: Takatoshi Yoshiyama, Hamamatsu (JP); Kazutaka Suzuki, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/787,539

(22) Filed: Feb. 27, 2004

(65) Prior Publication Data

US 2005/0190886 A1 Sep. 1, 2005

(51) Int. Cl.
*H01J 35/18* (2006.01)
*H01J 35/20* (2006.01)

(52) U.S. Cl. ..... 378/123; 378/140

(58) Field of Classification Search ..... 378/121, 378/123–142

See application file for complete search history.

(56) References Cited

U.S. PATENT DOCUMENTS

| | | | | | |
|---|---|---|---|---|---|
| 1,409,460 | A * | 3/1922 | Mutscheller | ..... | 378/123 |
| 1,904,392 | A * | 4/1933 | Stintzing et al. | ..... | 378/125 |
| 2,497,479 | A * | 2/1950 | Vlach | ..... | 378/125 |
| 4,130,773 | A * | 12/1978 | Kussel | ..... | 378/123 |
| 4,646,338 | A | 2/1987 | Skillicorn | ..... | 378/110 |
| 4,646,480 | A | 3/1987 | Williams | ..... | 51/424 |
| 5,077,771 | A | 12/1991 | Skillicorn et al. | ..... | 378/102 |
| 5,517,545 | A | 5/1996 | Nakamura et al. | ..... | 378/101 |
| 5,563,923 | A | 10/1996 | Okada et al. | ..... | 378/138 |
| 6,229,876 | B1 | 5/2001 | Enck et al. | | |
| 6,490,341 | B1 | 12/2002 | Ochiai et al. | ..... | 378/140 |
| 6,639,969 | B1 * | 10/2003 | Ochiai et al. | ..... | 378/119 |
| 2003/0068013 | A1 | 4/2003 | Ochiai et al. | ..... | 378/140 |
| 2005/0147207 | A1 * | 7/2005 | Ochiai et al. | ..... | 378/121 |

FOREIGN PATENT DOCUMENTS

| | | |
|---|---|---|
| JP | 7-296751 | 11/1995 |
| JP | 11-224624 | 8/1999 |

* cited by examiner

*Primary Examiner*—Edward J. Glick
*Assistant Examiner*—Krystyna Suchecki
(74) *Attorney, Agent, or Firm*—Drinker Biddle & Reath LLP

(57) ABSTRACT

The present invention discloses an X-ray tube comprising a vacuum envelope comprising a first tubular part having an X-ray exit window in an opening on a leading end side and an attachment flange on a base end side, and a second tubular part communicating with the inside of the first tubular part and projecting from a peripheral part of the first tubular part; and an electron gun and a target both contained in the vacuum envelope. The electron gun emits an electron beam to the target, the target generates an X-ray in response, and thus generated X-ray is taken out through the X-ray exit window. An exhaust pipe for evacuating the vacuum envelope projects from the peripheral face of the first tubular part. The exhaust pipe is disposed inside a virtual surface covering the periphery of the first tubular part and bridging a periphery of a leading end portion of the first tubular part and a periphery of the attachment flange.

13 Claims, 12 Drawing Sheets

X-RAY TUBE

BACKGROUND OF THE INVENTION

1. Field of the Invention

The present invention relates to an X-ray tube incorporated in an X-ray generator used for a nondestructive inspection of a sample and the like.

2. Related Background Art

As an apparatus for inspecting the internal structure of a sample without destroying the sample, an X-ray generator incorporating therein an X-ray tube for irradiating a sample with an X-ray has conventionally been known in general (see, for example, Japanese Patent Application Laid-Open No. HEI 11-224624). As a part of a nondestructive inspection system for obtaining a fluoroscopic image of a sample, the X-ray generator is used together with an X-ray imaging apparatus (XI) which detects an X-ray transmitted through the sample. As the distance from the X-ray to the sample is shorter, the fluoroscopic image is obtained with a greater magnification.

As the X-ray tube, one comprising an X-ray generating part having a structure in which a target is contained in a tubular part having an X-ray exit window and an electron gun part having a structure in which an electron gun is contained in a tubular part projecting from the periphery of the tubular part of the X-ray generating part has conventionally been known in general (see, for example, Patent Document 2). This X-ray tube is configured such that the target generates an X-ray when the electron gun emits an electron beam thereto, and thus generated X-ray is taken out through the X-ray exit window.

Here, as shown in FIG. 1 of Japanese Patent Application Laid-Open No. HEI 11-224624, the X-ray tube is secured to the housing of the X-ray generator such that the X-ray generating part and the electron gun part are exposed to the outside. As shown in FIG. 5 of Japanese Patent Application Laid-Open No. HEI 11-224624, the X-ray generating part and housing of X-ray generator are formed with slopes for allowing the sample to incline about an axis orthogonal to the X-ray irradiating direction while the sample is disposed near the X-ray exit window of the X-ray tube.

In the conventionally known X-ray tube, an exhaust pipe (tip tube) projects from the peripheral face of the tubular part of the X-ray generating part. Hence, it has been pointed out that the exhaust pipe may hinder the sample or a sample table mounting the sample from greatly inclining about the axis orthogonal to the X-ray irradiating direction while the sample is disposed near the X-ray exit window, which may be problematic when observing a complicated internal structure of the sample three-dimensionally.

SUMMARY OF THE INVENTION

It is therefore an object of the present invention to provide an X-ray tube which can greatly incline the sample or the sample mounting table in the exhaust pipe projecting direction as well.

The present invention provides an X-ray tube comprising a vacuum envelope accommodating an electron gun and a target; the vacuum envelope comprising a first tubular part having an X-ray exit window in an opening on a leading end side and an attachment flange on a base end side, and a second tubular part communicating with the inside of the first tubular part and projecting from a peripheral part of the first tubular part; wherein the electron gun emits an electron beam to the target, the target generates an X-ray in response, and thus generated X-ray is taken out through the X-ray exit window; wherein an exhaust pipe for evacuating the vacuum envelope projects from the peripheral face of the first tubular part; and wherein the exhaust pipe is disposed inside a virtual surface covering the periphery of the first tubular part and bridging a periphery of a leading end portion of the first tubular part and a periphery of the attachment flange.

When inclining a sample about an axis orthogonal to the X-ray irradiating direction while the sample is disposed near the X-ray exit window provided in the opening of the first tubular part in the X-ray tube in accordance with the present invention, the sample or sample mounting table can incline so greatly as to come into contact with the periphery of the leading end portion of the first tubular part or the periphery of the attachment flange without touching the exhaust pipe.

When the exhaust pipe is disposed near the attachment flange in the X-ray tube in accordance with the present invention, the tipoff length of the exhaust pipe can be increased within the range not coming into contact with the inclined sample or sample mounting table, whereby the X-ray tube can reliably be evacuated.

When a cut surface extending along an axis of the second tubular part is formed in the peripheral face of the first tubular part in the X-ray tube of the present invention, the sample or sample mounting table can be inclined more greatly along the cut surface, whereby a nondestructive inspection of the sample can be carried out more accurately while the sample is disposed closer to the X-ray exit window.

DESCRIPTION OF THE PREFERRED EMBODIMENTS

Figure 3:
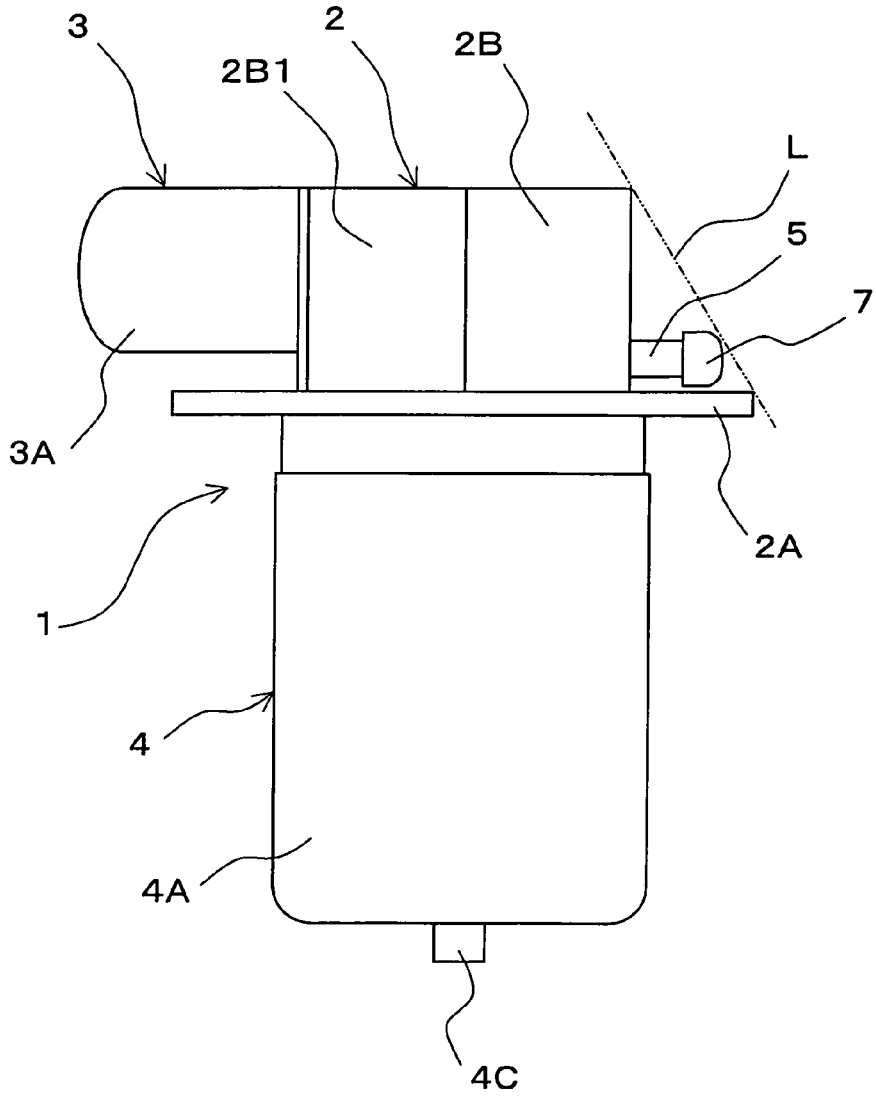
FIG. 3 is a view of the X-ray tube as seen in the direction of arrow III of FIG. 1.
Figure 4:
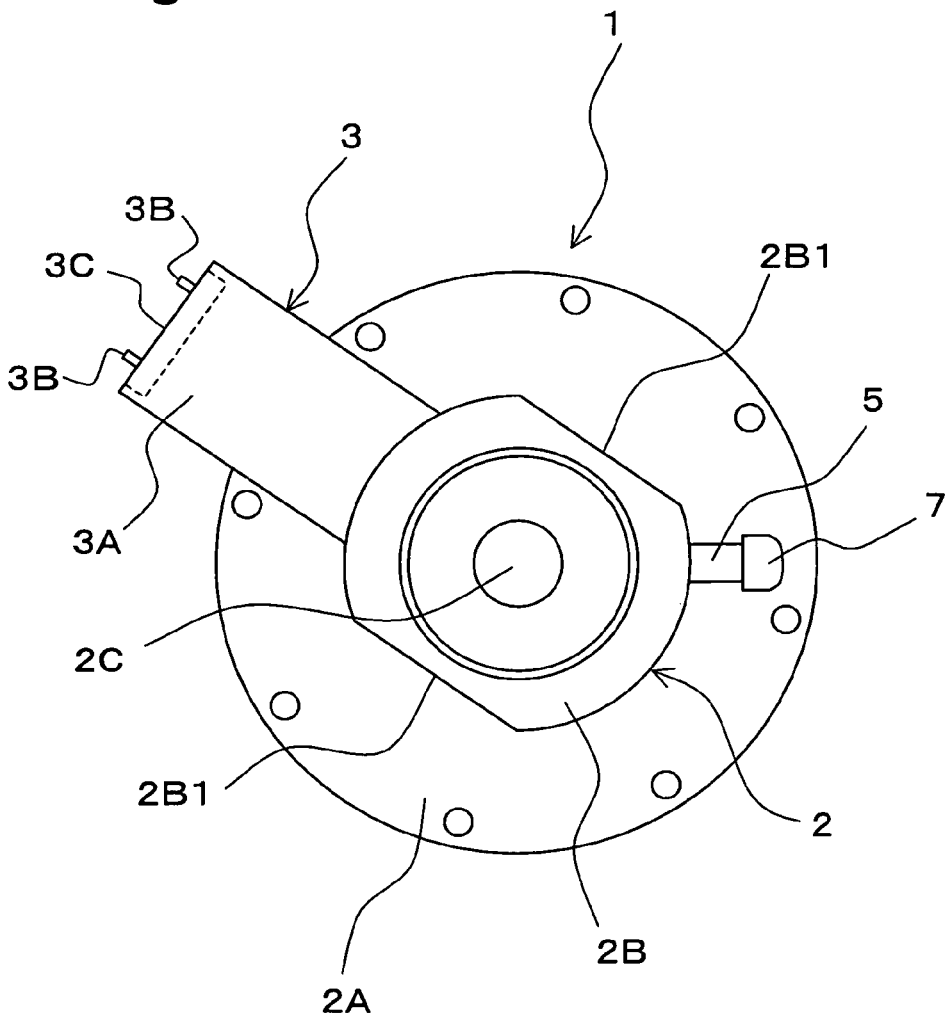
FIG. 4 is a view of the X-ray tube as seen in the direction of arrow IV of FIG. 1.

In the following, embodiments of the X-ray tube in accordance with the present invention will be explained with reference to the drawings. Among the drawings, FIG. 1 is an overall perspective view showing the schematic structure of the X-ray tube in accordance with an embodiment of the present invention, FIG. 2 is a vertical sectional view of the X-ray tube shown in FIG. 1, FIG. 3 is a view of the X-ray tube as seen in the direction of arrow III of FIG. 1, and FIG. 4 is a view of the X-ray tube as seen in the direction of arrow IV of FIG. 1.

Figure 1:
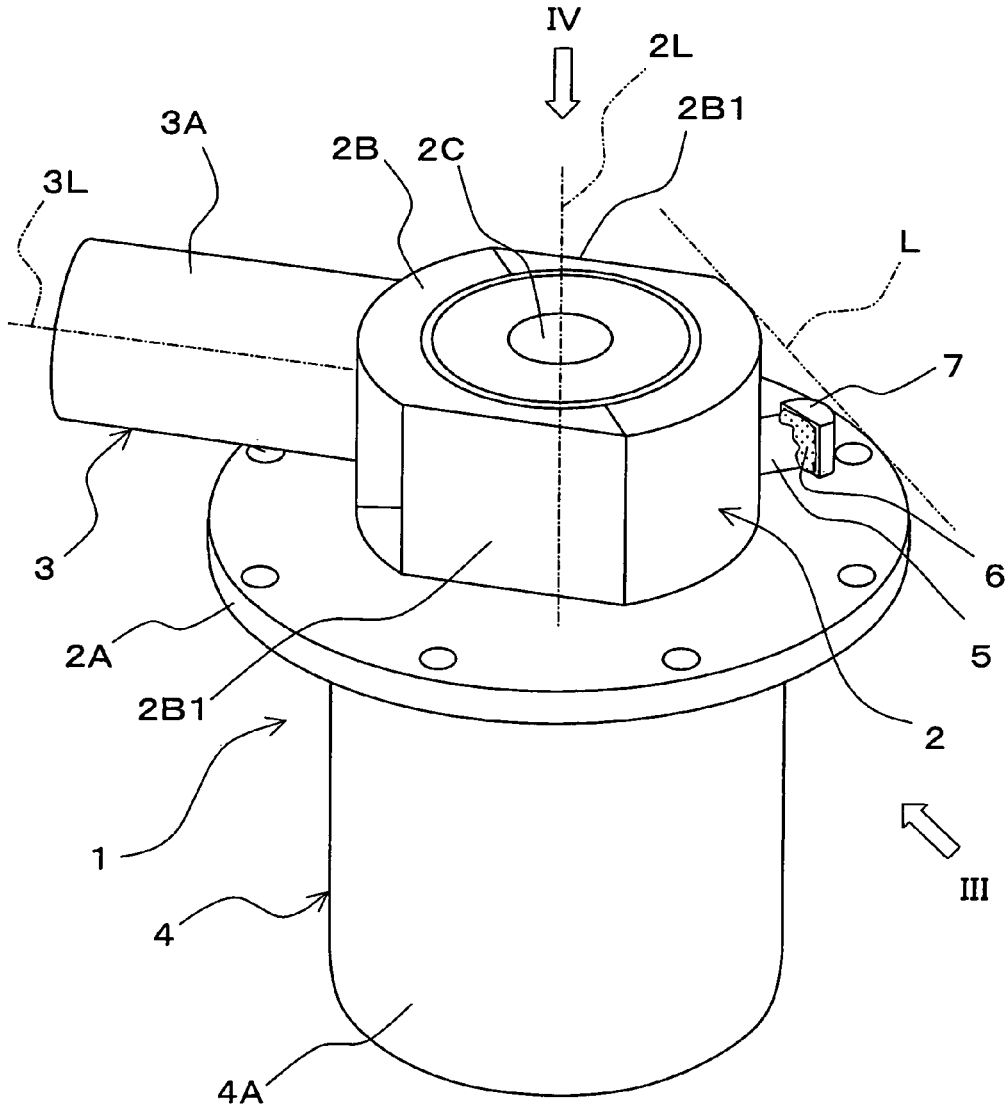
FIG. 1 is an overall perspective view showing the schematic structure of the X-ray tube in accordance with an embodiment of the present invention.
Figure 2:
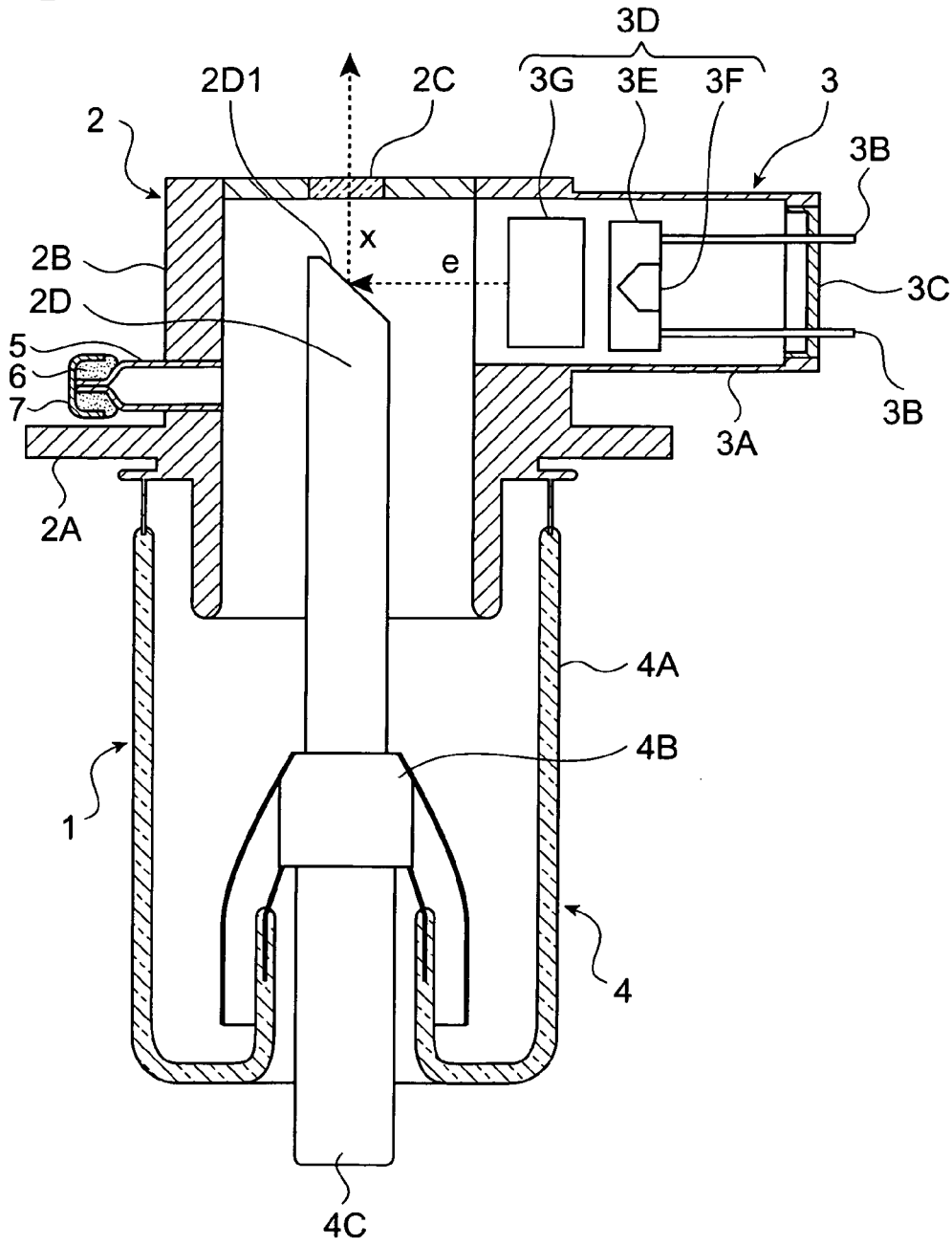
FIG. 2 is a vertical sectional view of the X-ray tube shown in FIG. 1.

As shown in FIGS. 1 and 2, the X-ray tube 1 in accordance with an embodiment comprises an X-ray generating part 2, an electron gun part 3, a bulb part 4, etc. A first tubular part 2B of the X-ray generating part 2, a second tubular part 3A of the electron gun part 3, and a bulb 4A of the bulb part 4, which will be explained later, constitute a vacuum envelope.

The X-ray generating part 2 includes the first tubular part 2B having a base end portion formed with an attachment flange 2A, whereas an X-ray exit window 2C is attached to an opening on the leading end side of the first tubular part 2B. Accommodated within the first tubular part 2B is a reflection type support member 2D which generates an X-ray (x) in response to an electron beam (e) incident thereon (see FIG. 2). The support member 2D is located on a plane, formed in the leading end portion of the support member 2D held in an insulated state at the center part of the bulb 4A constituting the body of the bulb part 4, obliquely intersecting the axis of the support member 2D.

The electron gun part 3 includes the second tubular part 3A communicating with the inside of the first tubular part 2B of the X-ray generating part 2 and projecting from the peripheral face of the first tubular part 2B, whereas a stem 3C holding power-supplying stem pins 3B is attached to the opening on the leading end side of the second tubular part 3A. Accommodated within the second tubular part 3A is an electron gun 3D for emitting the electron beam (e) to a target 2D1 of the support member 2D contained in the first tubular part 2B.

The electron gun 3D comprises a heater 3E which generates heat when power is supplied from the stem pins 3B, a cathode 3F which releases thermoelectrons when heated by the heater 3E, a focusing grid electrode 3G which emits the electron beam (e) to the target 2D1 of the support member 2D by focusing and accelerating the thermoelectrons released from the cathode 3F, etc.

Here, as shown in FIGS. 1 to 3, a pair of cut faces 2B1, 2B1 parallel to the axis 3L of the second tubular part 3A of the electron gun part 3 are formed on the peripheral face of the first tubular part 2B of the X-ray generating part 2 so as to be in parallel with the axis 2L of the first tubular part 2B. An exhaust pipe (tip tube) 5 for evacuating the X-ray tube 1 projects from the peripheral face of the first tubular part 2B on the side opposite from the side where the second tubular part 3A projects.

The exhaust pipe 5 has an inner end part communicating with the inside of the first tubular part 2B (see FIG. 2), and an outer end part tipped off so as to keep the vacuum state within the X-ray tube 1. A protective cap 7 is secured to the flatly collapsed and cut tipoff end of the outer end part of the exhaust pipe 5 with a synthetic resin adhesive 6.

Inside a virtual surface covering the peripheral face of the first tubular part 2B while bridging the periphery of the leading end portion of the first tubular part 2B and the periphery of the attachment flange 2A, such an exhaust pipe 5 is disposed near the attachment flange 2A. Namely, the exhaust pipe 5 is disposed so as to be kept from projecting out of a virtual line L connecting the periphery of the leading end portion of the first tubular part 2B and the periphery of the attachment flange 2A as indicated by the dash-double-dot line in FIGS. 1 and 3.

Thus configured X-ray tube 1 in accordance with this embodiment is incorporated in an X-ray generator, for example, by securing the attachment flange 2A to the housing of an undepicted X-ray generator while in a state where the X-ray generating part 2 and electron gun part 3 are exposed to the outside of the housing.

Figure 5:
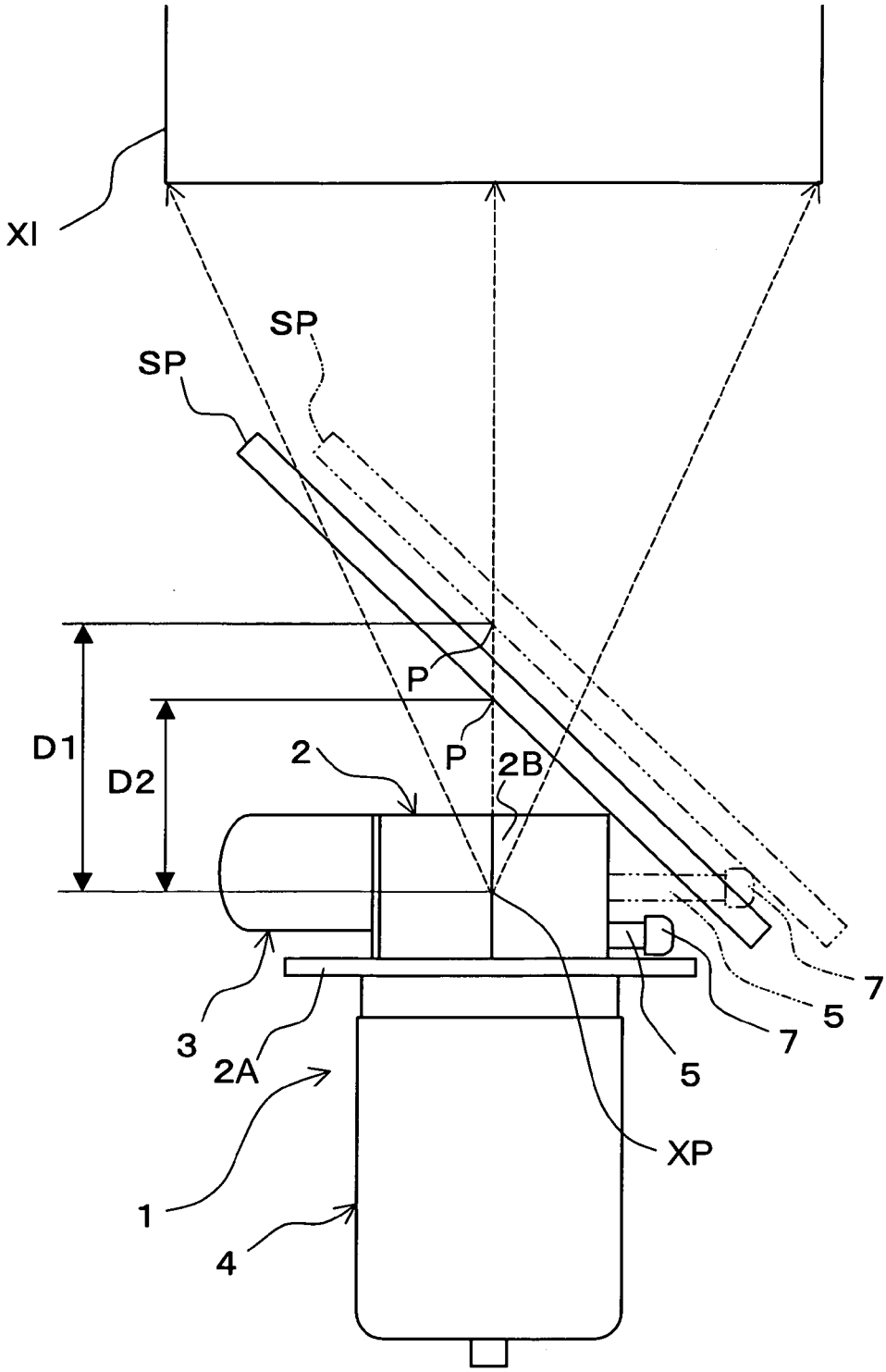
FIG. 5 is a side view for explaining a first operation of the X-ray tube in accordance with the embodiment.
Figure 6:
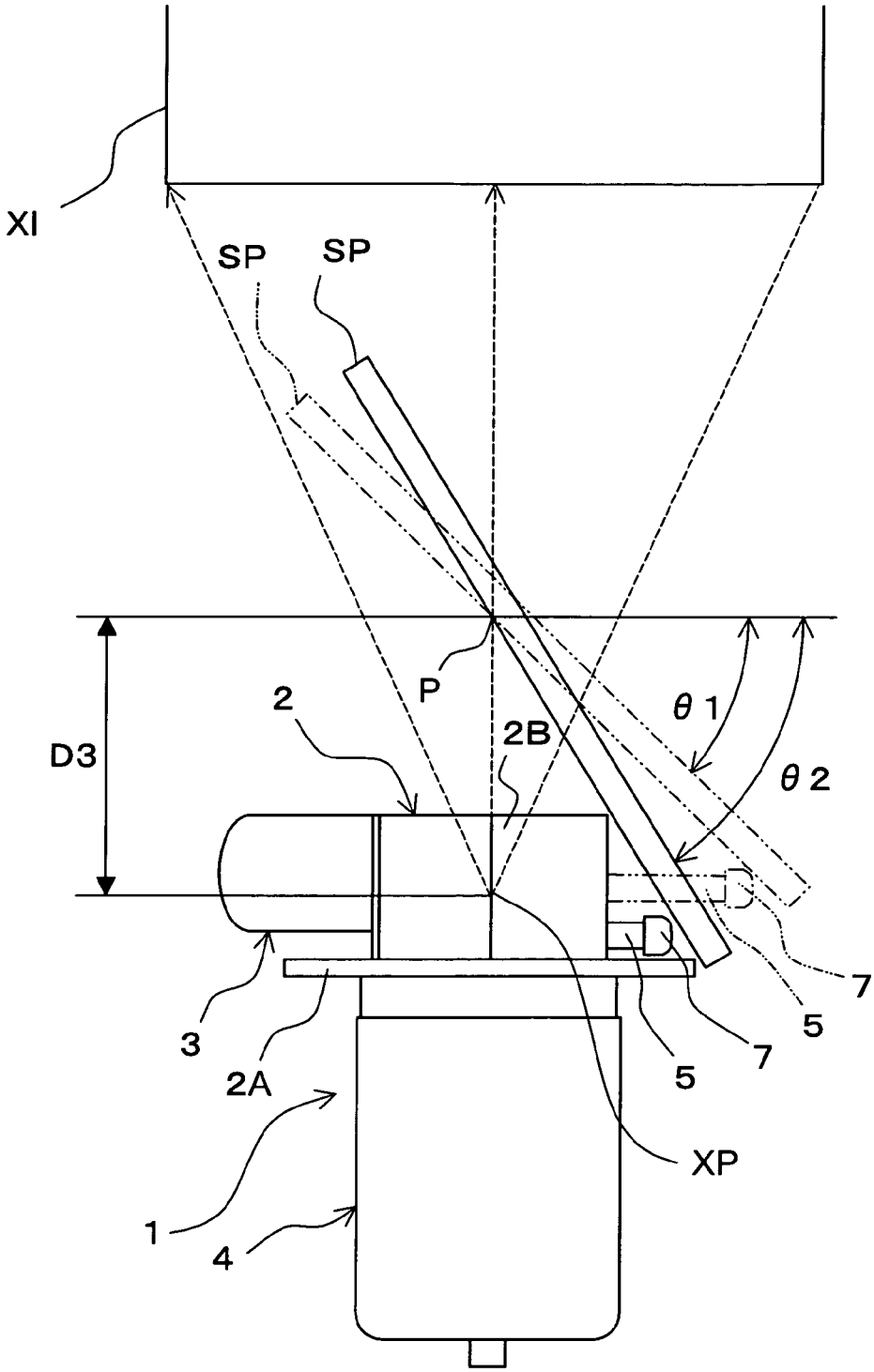
FIG. 6 is a side view for explaining a second operation of the X-ray tube in accordance with the embodiment.

As shown in FIGS. 5 and 6, the X-ray tube 1 incorporated in the X-ray generator as such emits the X-ray (x) (see FIG. 2) from the X-ray exit window 2C to an X-ray imaging apparatus XI in order for the X-ray imaging apparatus XI to observe the internal structure of a sample plate SP, which is a planar sample disposed between the X-ray tube 1 and the X-ray imaging apparatus XI, as a fluoroscopic image.

Since the magnification of the fluoroscopic image of the sample plate SP obtained by the X-ray imaging apparatus XI becomes greater as the distance from an X-ray generating point XP of the X-ray tube 1 to the sample plate SP is shorter, the sample plate SP is usually disposed close to the X-ray generating point XP. When observing the internal structure of the sample plate SP three-dimensionally, the sample plate SP is inclined about an axis orthogonal to the X-ray irradiating direction.

In the three-dimensional observation with an observation point P of the sample plate SP disposed close to the X-ray generating point XP while in a state where the sample plate SP is inclined about the axis orthogonal to the X-ray irradiating direction in a conventional example in which the exhaust pipe 5 projects greatly as indicated by dash-double-dot lines as shown in FIG. 5, the observation point P of the sample plate SP cannot approach the X-ray generating point XP from the position where the sample plate SP is in contact with the protective cap 7, i.e., the position where the distance from the X-ray generating point XP to the observation point P is D1.

In the X-ray tube 1 in accordance with the embodiment in which the exhaust pipe 5 and the protective cap 7 are disposed on the inside of the virtual line L as shown in FIG. 2, by contrast, the observation point P of the sample plate SP can approach the X-ray generating point XP up to the position where the sample plate SP is in contact with the periphery of the leading end portion of the first tubular part 2B, i.e., the position where the distance from the X-ray generating point XP to the observation point P becomes D2, as indicated by solid lines in FIG. 5. As a result, the fluoroscopic image of the observation point P of the sample plate SP can be magnified more, so as to carry out a nondestructive inspection of the observation point P more accurately.

When three-dimensionally observing the observation point P of the sample plate SP located at a distance D3 from the X-ray generating point XP by inclining the sample plate SP about the axis orthogonal to the X-ray irradiating direction as shown in FIG. 6, on the other hand, the sample plate SP cannot be inclined more than the angle θ1 at which the sample plate SP is in contact with the protective cap 7 in the conventional example in which the exhaust pipe 5 projects greatly as indicated by dash-double-dot lines.

In the X-ray tube 1 in accordance with the embodiment in which the exhaust pipe 5 and the protective cap 7 are disposed on the inside of the virtual line L as shown in FIG. 2, the sample plate SP can be inclined greatly up to the angle θ2 at which the sample plate SP is in contact with the periphery of the attachment flange 2A. As a result, the nondestructive inspection of the observation point P of the sample plate SP can be carried out more accurately in a three-dimensional fashion.

Since the exhaust pipe 5 is disposed near the attachment flange 2A in the X-ray tube 1 in this embodiment, the tipoff length of the exhaust pipe 5 can be increased within the range where the exhaust pipe 5 does not come into contact with the inclined sample plate SP as shown in FIGS. 5 and 6, whereby the X-ray tube 1 can reliably be evacuated.

Since the peripheral face of the first tubular part 2B in the X-ray generating part 2 is formed with the cut surfaces 2B1, 2B1 extending along the axis of the second tubular part 3A of the electron gun part 3 in the X-ray tube 1 in accordance with this embodiment, the sample plate SP can be inclined more by tilting it toward the cut surfaces 2B1, 2B1, and can be moved closer to the X-ray generating point XP.

Figure 7:
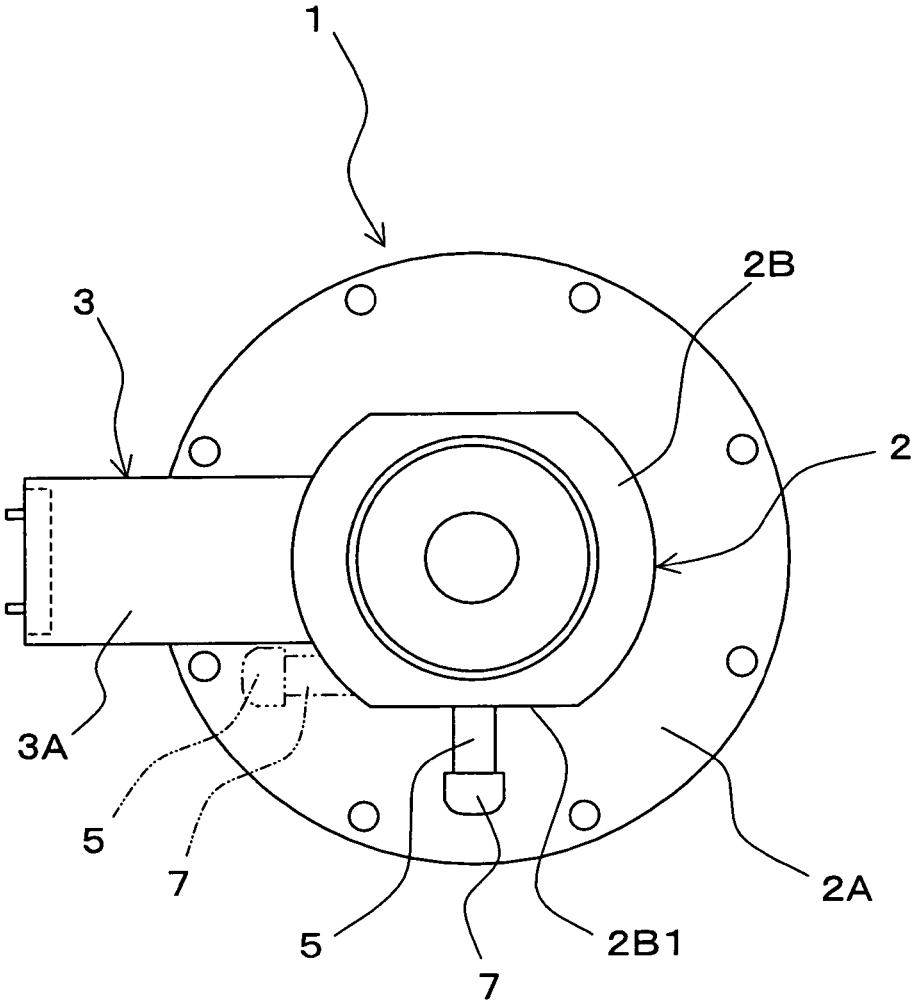
FIG. 7 is a view showing, in a fashion corresponding to FIG. 4, a modified example of arrangement of an exhaust pipe shown in FIG. 1.

The X-ray tube in accordance with the present invention is not limited to the above-mentioned embodiment. For example, the exhaust pipe 5 may be disposed so as to project from one cut surface 2B1 of the first tubular member 2B as indicated by solid lines in FIG. 7 or project along the second tubular part 3A of the electron gun part 3 as indicated by dash-double-dot lines in FIG. 7.

When arranged near the attachment flange 2A, the exhaust pipe 5 projecting from one cut surface 2B1 of the first tubular part 2B can further increase the tipoff length, thereby making it possible to evacuate the X-ray tube 1 more reliably.

The attachment flange 2A projecting from the base end side of the first tubular part 2B can attain any form such as quadrangular and hexagonal forms without being restricted to the depicted circular form.

In the vicinity of the electron gun part 3, the virtual surface covering the peripheral face of the first tubular part 2B while bridging the periphery of the leading end portion of the first tubular part 2B and the periphery of the attachment flange 2A may be a virtual surface bridging three components of the periphery of the leading end portion of the first tubular part 2B, the outer periphery of the second tubular part 3A, and the periphery of the attachment flange 2A.

In the X-ray tube in accordance with the present invention, as explained in the foregoing, the exhaust pipe is disposed on the inside of the virtual surface covering the peripheral face of the first tubular part while bridging the periphery of the leading end portion of the first tubular part having the X-ray exit window in the opening on the leading end side and the periphery of the attachment flange. Therefore, when the sample is inclined about the axis orthogonal to the X-ray irradiating direction while being disposed close to the X-ray exit window, the sample or sample mounting table can greatly be tilted until it comes into contact with the periphery of the leading end portion of the first tubular part or the periphery of the attachment flange in the exhaust tube projecting direction as well.

Figure 8:
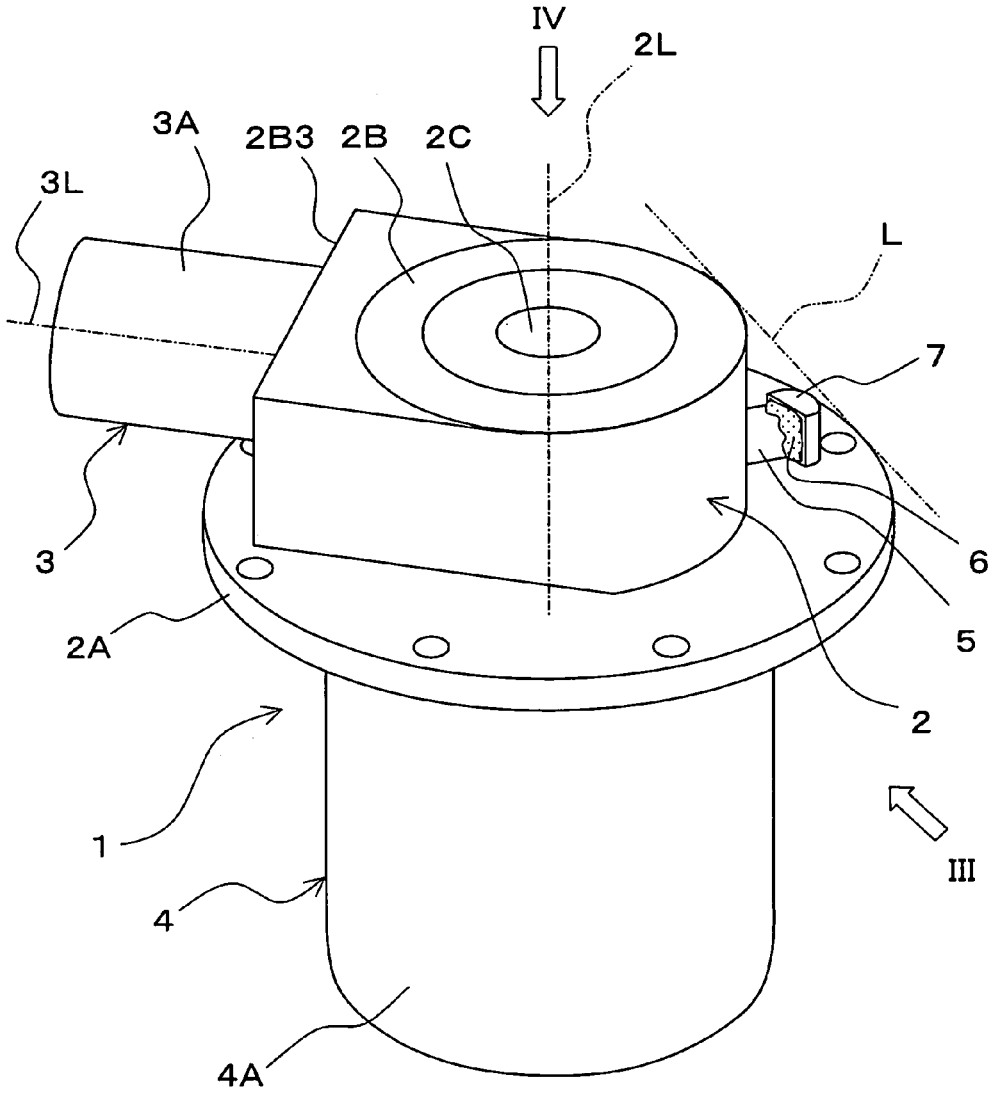
FIG. 8 is a view showing another embodiment in accordance with the present invention.

FIG. 8 shows another embodiment in accordance with the present invention.

In this embodiment, as shown in FIG. 8, the X-ray generating part 2 has a shape combining a semicylindrical part with a rectangular parallelepiped part instead of the cut surfaces 2B1, 2B1 shown in FIG. 1, whereas the second tubular part 3A of the electron gun part 3 is secured to one flat face 2B3 of the rectangular parallelepiped part in the X-ray generating part 2.

Figure 9:
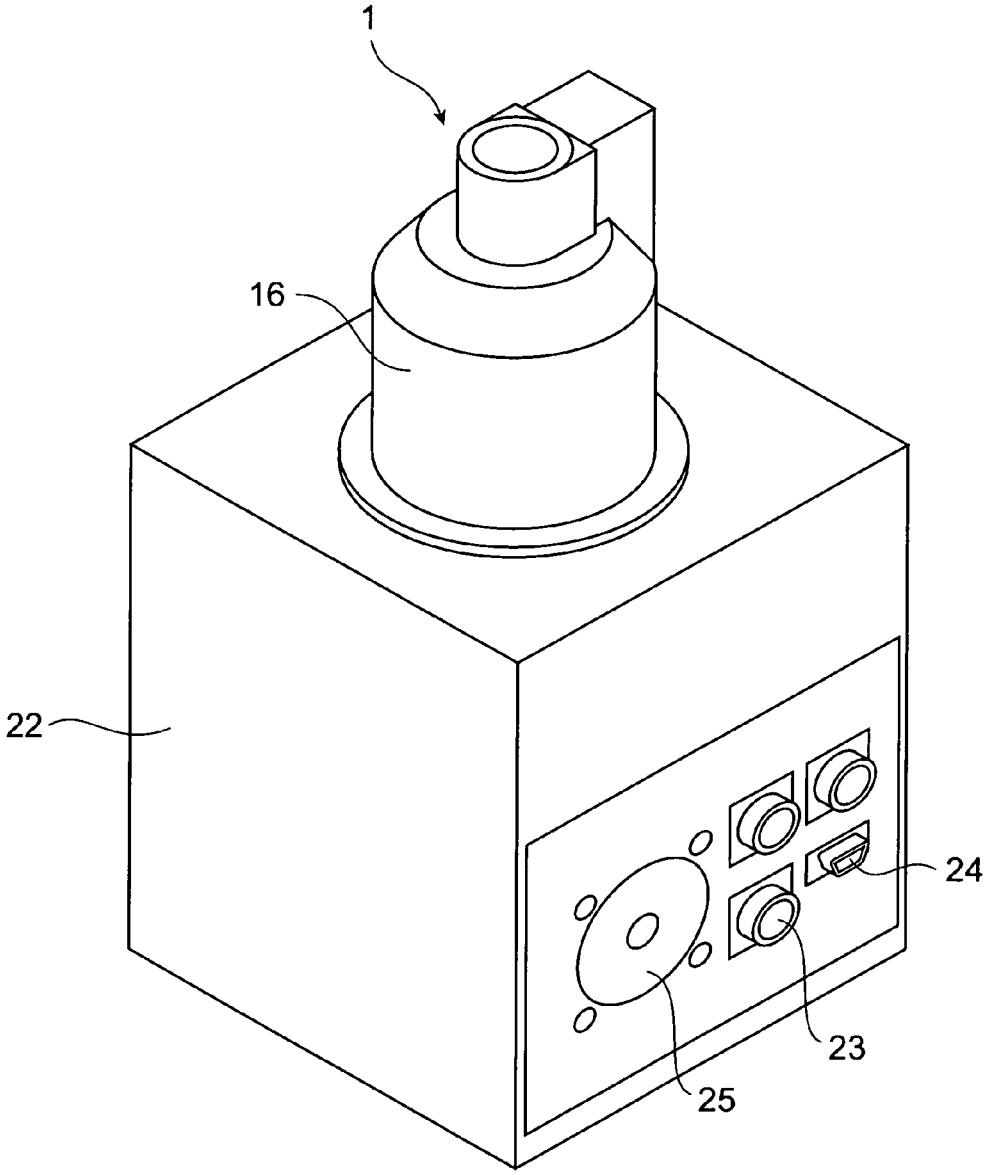
FIG. 9 is a schematic perspective view of an X-ray source incorporating therein the embodiment shown in FIG. 8.

FIG. 9 is a schematic perspective view showing an X-ray source 10 incorporating therein the X-ray tube in accordance with this embodiment.

Figure 10:
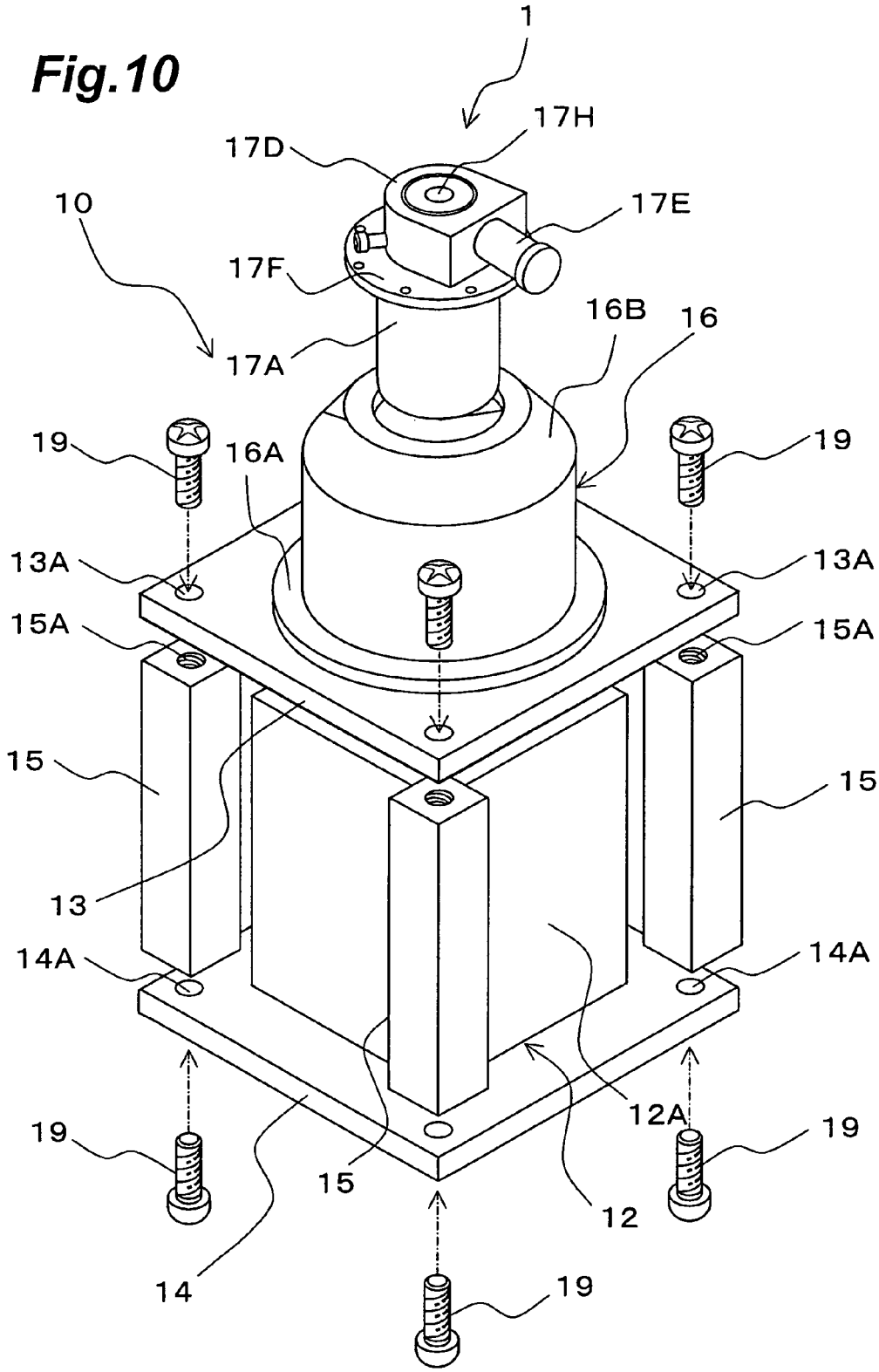
FIG. 10 is an exploded perspective view of the X-ray source shown in FIG. 9.
Figure 11:
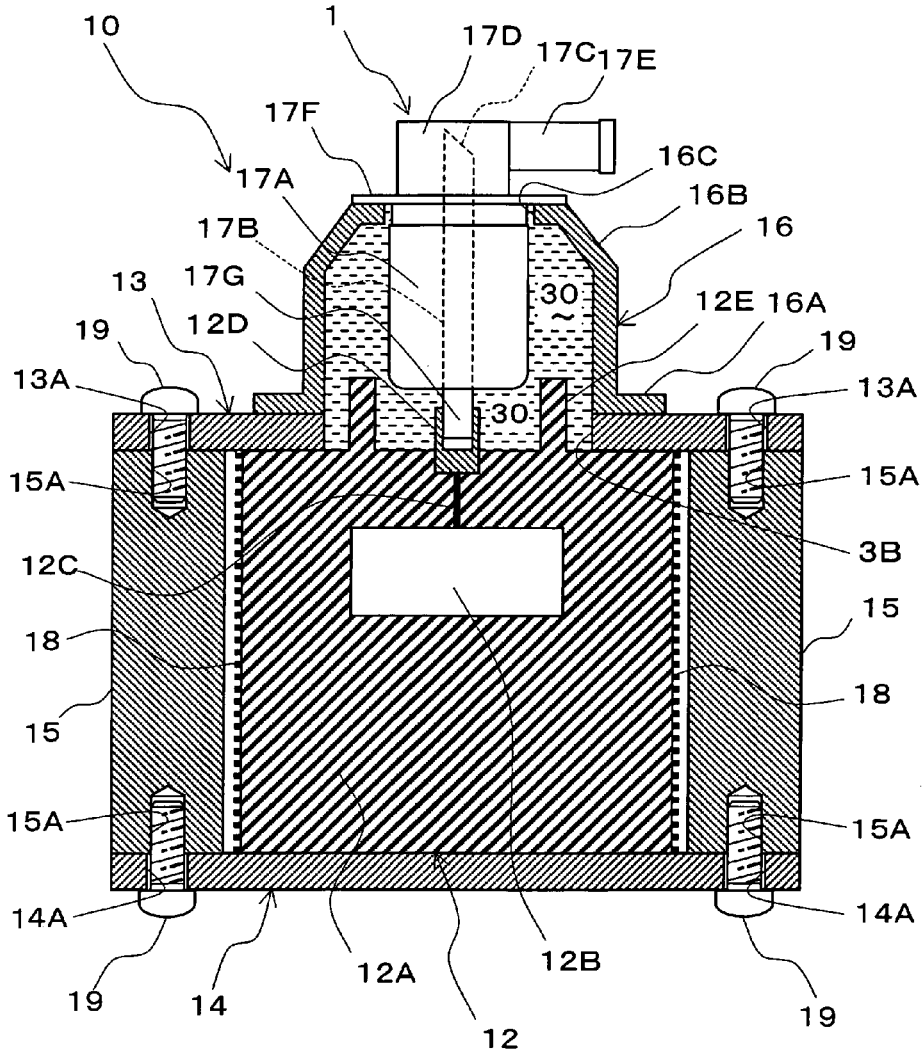
FIG. 11 is a vertical sectional view showing the internal structure of the X-ray source 10 shown in FIG. 10.

As shown in FIG. 9, the X-ray tube 1 is secured to a block part 22 by way of a metallic tubular member 16. As shown in FIG. 9, the upper part of the metallic tubular member 16 is shaped into a truncated cone. As depicted, a power connector 23, a signal terminal 24, a cooling fan 25, etc. are attached to one side face of the block part 22. FIG. 10 is an exploded perspective view of the X-ray source shown in FIG. 9, illustrating a state without the casing of the block part 22 shown in FIG. 9. FIG. 11 is a vertical sectional view showing the internal structure of the X-ray source 10 shown in FIG. 10.

As shown in FIGS. 10 and 11, the X-ray source 10 comprises a power supply 12 in which a high-voltage generating part 12B, a high-voltage line 12C, a socket 12D, etc. (see FIG. 11) are molded in an insulating block 12A made of an epoxy resin; a first planar member 13 disposed on the upper face side of the insulating block 12A on the upper side in the drawings; a second planar member 14 disposed on the lower face side of the insulating block 12A; four fastening spacer members 15 interposed between the first planar member 13 and second planar member 14; and the X-ray tube 1 secured onto the first planar member 13 by way of the metallic tubular member 16.

The insulating block 12A of the power supply 12 is shaped like a rectangular column with substantially square upper and lower faces parallel to each other, whereas the cylindrical socket 12D connected to the high-voltage generating part 12B by way of the high-voltage line 12C is disposed at the center part of the upper face. An annular wall 12E arranged concentrically with the socket 12D projects from the upper face of the insulating block 12A. The peripheral face of the insulating block 12A is coated with conductive paint 18 for attaining the GND potential (ground potential).

The first planar member 13 and second planar member 14 are members cooperating with four fastening spacer members 15 and eight fastening screws 19, for example, so as to hold the insulating block 12A of the power supply 12 from the upper and lower sides in the drawing, and are shaped into substantially square forms greater than the upper and lower faces of the insulating block 12A, respectively. At the corners of the first planar member 13 and second planar member 14, screw insertion holes 13A, 14A for inserting the fastening screws 19 are formed. The first planar member 13 is formed with a circular opening 13B surrounding the annular wall 12E projecting from the upper face of the insulating block 12A.

The four fastening spacer members 15, each formed like a square column, are disposed at the corners of the first planar member 13 and second planar member 14. Each fastening spacer member 15 is slightly shorter than the gap between the upper and lower faces of the insulating block 12A, i.e., by the fastening margin of the insulating block 12A. The upper and lower end faces of each fastening spacer member 15 are formed with respective screw holes 15A into which a fastening screw 19 is screwed.

The metallic tubular member 16 is shaped like a cylinder, whereas an attachment flange 16A formed at the base end part thereof is secured to the surroundings of the opening 13B of the first planar member 13 by screwing by way of a seal member. The peripheral face of the leading end part of the metallic tubular member 16 is formed into a tapered surface 16B, whereby the metallic tubular member 16 attains a tapered leading end part with no corners. A flat leading end face continuing to the tapered surface 16B of the metallic tubular member 16 is formed with an opening 16C through which a bulb part 17A of the X-ray tube 1 is inserted.

The X-ray tube 1 is a reflection type X-ray tube comprising the bulb part 17A holding and accommodating a support member 17B (having a target) while being insulated from the support member 17B, an X-ray generating part 17D containing a target 17C provided at the leading end part of the support member 17B, and an electron gun part 17E for emitting an electron beam to the target 17C.

The bulb part 17A and the X-ray generating part 17D are arranged concentrically, whereas their axis is substantially orthogonal to the axis of the electron gun part 17E. An attachment flange 17F to be secured to the leading end face of the metallic tubular member 16 is formed between the bulb part 17A and the X-ray generating part 17D. As a high-voltage applying part 17G, the base end part of the support member 17B (having the target) projects downward from the center part of the bulb part 17A.

As explained above, the X-ray tube 1 is provided with an exhaust pipe, through which the bulb part 17A, the X-ray generating part 17D, and the electron gun part 17E are evacuated, whereby a sealed vacuum container is formed.

Such an X-ray tube 1 is constructed so as to receive a high voltage from the high-voltage generating part 12B by way of the high-voltage line 12C when the high-voltage applying part 17G fits into the socket 12D molded in the insulating block 12A of the power supply 12. When an electron gun built in the electron gun part 17E emits an electron beam to the target 17C in this state, an X-ray generated in response to the electron beam incident on the target 17C is emitted from an X-ray exit window 17H attached to the opening of the X-ray generating part 17D.

The X-ray source 10 is assembled by the following manner, for example. First, four fastening screws 19 inserted through their corresponding screw insertion holes 14A of the second planar member 14 are screwed into the respective screw holes 15A in the lower end faces of the four fastening spacer members 15. Subsequently, four fastening screws 19 inserted through their corresponding screw insertion holes 13A of the first planar member 13 are screwed into the respective screw holes 15A in the upper end faces of the four fastening spacer members 15, whereby the first planar member 13 and second planar member 14 are fastened to each other while holding the insulating block 12A from the upper and lower sides. Here, respective seal members are interposed between the first planar member 13 and the upper face of the insulating block 12A, and between the second planar member 14 and the lower face of the insulating block 12A.

Next, a high-voltage insulating oil 30 is injected as an insulating liquid material into the opening 16C of the metallic tubular member 16 secured onto the first planar member 13. Subsequently, the bulb part 17A of the X-ray tube 1 is inserted into the metallic tubular member 16 from the opening 16C thereof, so as to be dipped into the high-voltage insulating oil 30, whereby the high-voltage applying part 17G projecting downward from the center part of the bulb part 17A fits into the socket 12D on the power supply 12 side. Then, the attachment flange 17F of the X-ray tube 1 is secured to the leading end face of the metallic tubular member 6 by fastening by way of a seal member.

Figure 12:
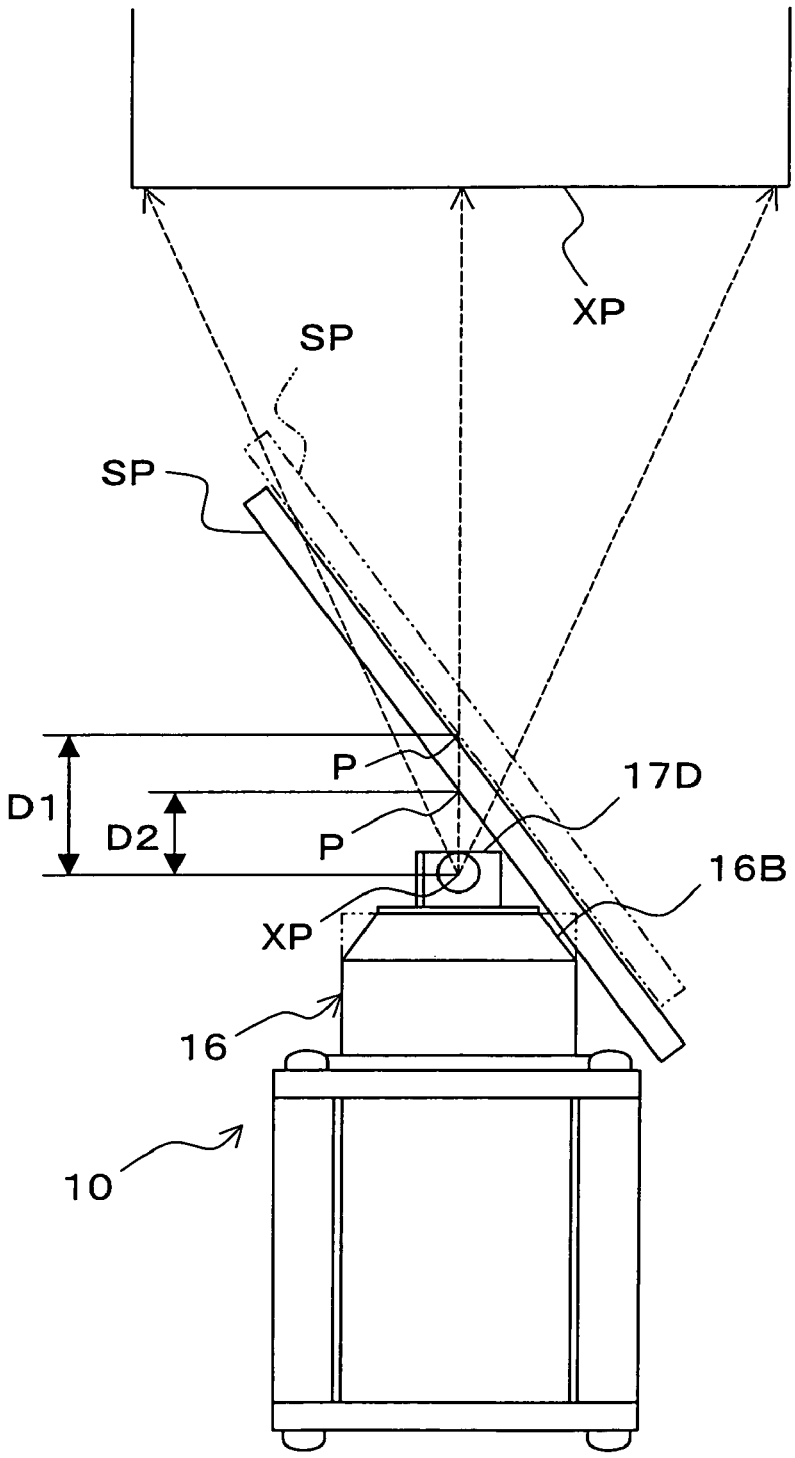
FIG. 12 is a front view for explaining an operation of the X-ray source in accordance with an embodiment incorporated in an X-ray generator of a nondestructive inspection apparatus.

In thus assembled X-ray source 10, as shown in FIG. 12, the annular wall 12E projecting from the upper face of the insulating block 12A of the power supply 12 and the metallic tubular member 16 are arranged concentrically about the axis of the support member 17B (having the target) of the X-ray tube 1. The annular wall 12E surrounds the high-voltage applying part 17G protruded from the bulb part 17A of the X-ray tube 1, and projects by such a height as to shield the high-voltage applying part 17G from the metallic tubular member 16.

When a high voltage is applied to the high-voltage applying part 17G of the X-ray tube 1 from the high-voltage generating part 12B of the power supply 12 by way of the high-voltage line 12C and socket 12D in the X-ray source 10, the target 17C is supplied with the high voltage by way of the support member 17B (having the target). When the electron gun incorporated in the electron gun part 17E of the X-ray tube 1 emits an electron beam to the target 17C accommodated in the X-ray generating part 17D in this state, an X-ray generated in response to the electron beam incident on the target 17C is emitted from the X-ray exit window 17H attached to the opening of the X-ray generating part 17D.

Since the metallic tubular member 16 accommodating the bulb part 17A of the X-ray tube 1 in the state dipped in the high-voltage insulating oil 30 is secured to the outside of the insulating block 12A of the power supply 12, i.e., onto the first planar member 13, while projecting therefrom, the thermal dissipation characteristic of the X-ray tube 1 is favorable, whereby the dissipation of heat from the high-voltage insulating oil 30 and the bulb part 17A of the X-ray tube 1 within the metallic tubular member 16 can be accelerated.

The metallic tubular member 16 is formed like a cylinder about the support member 17B (having the target), so as to keep the same distance from the support member 17B (having the target), and thus can stabilize electric fields formed about the support member 17B (having the target) and target 17C. This metallic tubular member 16 can effectively cause the charged high-voltage insulating oil 30 to discharge.

Since the annular wall 12E projecting from the upper face of the insulating block 12A of the power supply 12 surrounds the high-voltage applying part 17G projecting from the bulb part 17A of the X-ray tube 1 and shields it from the metallic tubular member 16, abnormal discharges from the high-voltage applying part 17G to the metallic tubular member 16 can effectively be prevented from occurring.

The X-ray source 10 comprises a structure in which the insulating block 12A of the power supply 12 is held between the first planar member 13 and second planar member 14 fastened to each other by way of the four fastening spacer members 15, whereas the inside of the insulating block 12A is free of conductive foreign matters inducing discharges and electrifiable foreign matters inducing disturbances in electric fields. Therefore, the X-ray source 10 can suppress useless discharge phenomena and electric field disturbances in the power supply 12.

The X-ray source 10 can be used while being incorporated into an X-ray generator for irradiating a sample with an X-ray in a nondestructive inspection apparatus for observing the internal structure of a sample as a fluoroscopic image, for example. FIG. 12 shows an example of use thereof, in which the X-ray source 10 emits an X-ray to a sample plate SP disposed between the X-ray source 10 and an X-ray imaging apparatus XI. Namely, the X-ray source 10 irradiates the sample plate SP with the X-ray through the X-ray exit window from the X-ray generating point XP of the target incorporated in the X-ray generating part 17D projecting above the metallic tubular member 16.

In such an example, since the magnification of the fluoroscopic image of the sample plate SP obtained by the X-ray imaging apparatus XI becomes greater as the distance from the X-ray generating point XP to the sample plate SP is shorter, the sample plate SP is usually disposed close to the X-ray generating point XP. When observing the internal structure of the sample plate SP three-dimensionally, the sample plate SP is inclined about an axis orthogonal to the X-ray irradiating direction.

If corners indicated by dash-double-dot lines remain in the leading end part of the metallic tubular member 16 in the X-ray source 10 as shown in FIG. 12 when three-dimensionally observing the observation point P of the sample plate SP while disposing it close to the X-ray generating point XP in a state where the sample plate SP is inclined about an axis orthogonal to the X-ray irradiating direction, the observation point P of the sample plate SP cannot approach the X-ray generating point XP from the position where the sample plate SP is in contact with the leading end corner of the metallic tubular member 16, i.e., the position where the distance from the X-ray generating point XP to the observation point P is D1.

In the X-ray source 10 in which the leading end part of the metallic tubular member 16 is tapered by the taper surface 16B so as to yield no corners as shown in FIGS. 9 and 10, by contrast, the observation point P of the sample plate SP can approach the X-ray generating point XP up to the position where the sample plate SP comes into contact with the taper surface 16B of the metallic tubular member 16, i.e., the position where the distance from the X-ray generating point XP to the observation point P becomes D2, as indicated by solid lines in FIG. 12. As a result, the fluoroscopic image of the observation point P of the sample plate SP can be magnified more, so as to carry out a nondestructive inspection of the observation point P more accurately.

In the X-ray source 10, the metallic tubular member 16 preferably has an inner peripheral face with a circular cross section, but its outer peripheral face may be shaped like a polygon such as rectangle without being restricted to circular forms. When the outer peripheral face has a polygonal cross section, peripheral faces of the leading end part of the metallic tubular member can be formed like slopes.

The insulating block 12A of the power supply 12 may be formed like a cylindrical column, and the first planar member 13 and second planar member 14 may be formed like disks correspondingly thereto. The fastening spacer members 15 may be formed like cylindrical columns, whereas their number is not limited to 4.

What is claimed is:

1. An X-ray source comprising:

an X-ray tube comprising:

a vacuum envelope comprising a first tubular part having an X-ray exit window in an opening on a leading end side, a second tubular part communicating with the inside of the first tubular part and projecting from a peripheral part of the first tubular part, and a bulb part attached to the first tubular part, said X-ray tube comprising an attachment flange positioned at a base end side of the first tubular part, the first tubular part extending away from the attachment flange direction away from the bulb part; and an electron gun and a target both contained in the vacuum envelope;

wherein the electron gun emits an electron beam to the target, the target generates an X-ray in response, and the generated X-ray exits through the X-ray exit window; and wherein an exhaust pipe for evacuating the vacuum envelope projects from the peripheral face of the first tubular part; and a metallic tubular member attached to the X-ray tube with the attachment flange, wherein the metallic tubular member is located within a space covering the periphery of the first tubular part and defined by translation of a virtual line bridging a periphery of a leading end portion of the first tubular part and a periphery of the attachment flange around the entirety of the peripheries of the leading end portion of the first tubular part and the attachment flange, and at least one part of the metallic tubular member surrounds at least one part of the vacuum envelope without the metallic tubular member being in physical contact with the at least one part of the vacuum envelope.

2. The X-ray source according to claim 1, wherein the exhaust pipe is located within said space.

3. An X-ray source according to claim 1, wherein the exhaust pipe is disposed near the attachment flange.

4. An X-ray source according to claim 1, wherein a flat surface, extending along an axis along which the second tubular part extends, is formed in the peripheral face of the first tubular part.

5. The X-ray source according to claim 1, wherein the bulb part is inserted into the metallic tubular member.

6. The X-ray source according to claim 5, wherein the minimum inner diameter of the metallic tubular member is larger than a maximum diameter of the bulb part.

7. The X-ray source according to claim 1, wherein the metallic tubular member is physically separated from the X-ray tube except for the attachment flange.

8. The X-ray source according to claim 1, wherein the metallic tubular member comprises a first metallic tubular part having a tubular surface extending in a direction inclined with respect to an X-ray exiting direction.

9. The X-ray source according to claim 8, wherein the metallic tubular member further comprises a second metallic tubular part having a tubular surface extending in a direction parallel with the X-ray exiting direction.

10. The X-ray source according to claim 1, wherein the at least one part of the vacuum envelope is the bulb part.

11. The X-ray source according to claim 10, wherein the metallic tubular member is separate from the bulb part.

12. The X-ray source according to claim 10, wherein the bulb part is suspended within the metallic tubular member without the bulb part touching the metallic tubular member.

13. The X-ray source according to claim 1, wherein the metallic tubular member has an end portion with a conical shape, said end portion with the conical shape being located within said space.

* * * * *